US006902062B1

(12) United States Patent
Kumakura et al.

(10) Patent No.: US 6,902,062 B1
(45) Date of Patent: Jun. 7, 2005

(54) DISPENSING PACKAGE

(75) Inventors: Katsuhiko Kumakura, Kyoto (JP); Tadashi Ono, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/936,757

(22) PCT Filed: Mar. 6, 2000

(86) PCT No.: PCT/JP00/01359

§ 371 (c)(1),
(2), (4) Date: Sep. 17, 2001

(87) PCT Pub. No.: WO00/61444

PCT Pub. Date: Oct. 19, 2000

(30) Foreign Application Priority Data

Apr. 14, 1999 (JP) ..... 11-106679

(51) Int. Cl.[7] ..... B65D 75/00; B65D 85/00; A47F 1/04

(52) U.S. Cl. ..... 206/703; 206/443; 206/738; 206/784; 206/806; 221/102; 221/305; 221/309

(58) Field of Search ..... 206/576, 443, 206/446, 784, 526, 806, 703, 705, 427, 738; 229/104, 122, 162, 165, 122.1; 221/305, 309, 155, 281, 174, 175, 98, 100, 102, 66, 37, 34; 220/661, 676; 312/45; 211/162

(56) References Cited

U.S. PATENT DOCUMENTS 1,272,411 A * 7/1918 Fitz Gerald ..... 229/122.1
2,299,027 A * 10/1942 Novak ..... 206/738
2,385,400 A * 9/1945 Briggs ..... 206/705
3,450,308 A * 6/1969 Schoenefeld ..... 221/305
3,927,809 A * 12/1975 Klein, Sr. ..... 229/122.1
4,030,596 A 6/1977 Snyder et al.
D302,949 S * 8/1989 Eisendrath ..... D9/432
4,971,197 A * 11/1990 Worley ..... 206/705
5,145,070 A 9/1992 Pallet et al.
5,271,552 A 12/1993 McDonnell
5,460,322 A 10/1995 Carlson et al.
5,579,910 A 12/1996 Bennett
5,836,478 A * 11/1998 Weiss ..... 221/305

FOREIGN PATENT DOCUMENTS

EP 0 770 563 A1 5/1996
JP 53-42985 4/1978
JP 64-2726 1/1989

* cited by examiner

*Primary Examiner*—Mickey Yu
*Assistant Examiner*—J. Gregory Pickett
(74) *Attorney, Agent, or Firm*—Akin Gump Strauss Hauer & Feld, LLP

(57) ABSTRACT

A dispensing package that is capable of accommodating relatively a large number of stick-like articles, of separating old and new articles and of storing remaining articles as disclosed. This dispensing package comprises a case for accommodating therein unit packages containing a plurality of stick-like articles like batteries aligned in parallel by stacking a plurality of unit packages, an opening for putting in and taking out the unit packages provided on an upper part of the case, a lid for closing the opening, and a tear-off portion for forming the extracting outlet that is provided on a side wall corresponding to the unit package in the lowest position. The extracting outlet is formed on a side wall of the case facing to one end of the stick-like articles in the unit package. A large number of articles can be effectively displayed and a specified number of articles can be taken out smoothly.

11 Claims, 9 Drawing Sheets

DISPENSING PACKAGE

CROSS-REFERENCE TO RELATED APPLICATION

This application is a Section 371 of PCT/JP00/01359, published in English language on Oct. 19, 2000 under WO 00/61444, the disclosure of which is incorporated herein by reference.

TECHNICAL FIELD

The present invention relates to a dispensing package for accommodating and displaying stick-like small articles, especially small-sized cylindrical batteries such as AA size batteries for sales purpose or the like.

BACKGROUND OF THE INVENTION

Various kinds of packages for accommodating batteries and other daily necessaries are commercially available. In the field of batteries, widely used are so-called shrink-packages or blister-packages in which two or four batteries are wrapped by means of heat-shrinkable resin tubes. When such packages for accommodating articles are displayed, being aligned on a showcase at a storefront or suspended, customers can visually confirm with ease types, grades or brand names of contents, and the packages for accommodating articles are also conveniently portable.

However, with improvements in high-functional apparatuses utilizing batteries in these years, there exists a tendency that the number of utilized batteries are increasing or that the frequency of exchanging batteries is increasing, therefore battery packages that are capable of accommodating a large number of batteries are increasingly in demand. Such demands cannot be sufficiently satisfied with conventional shrink-packages or blister-packages.

In view of this point, it has been proposed to increase the number of accommodated batteries in shrink-packages or blister-packages and also a transparent plastic case for accommodating a large number of batteries by stacking has been proposed.

However, if merely the number of batteries is increased, the batteries scatter when the package is opened so that keeping of the batteries becomes troublesome for users. In the case of blister-packages, not only the number of batteries that can be displayed is restricted but also unnecessary portions such as "hems" of mounting board are increased to result in higher costs.

An object of the present invention is to provide a dispensing package that can solve the above inconveniences of conventional packages and that can accommodate a large number of small articles, especially batteries, and also convenient for users.

Another object of the present invention is to provide a dispensing package with which a large number of articles can be displayed in an effective manner.

Still another object of the present invention is to provide a dispensing package with which a specified number of articles can be taken out from the dispensing package in a systematic manner during storage.

Further object of the present invention is to provide a dispensing package with which a specified number of articles can be taken out in a smooth manner.

BRIEF SUMMARY OF THE INVENTION

The present invention provides a dispensing package comprising a case for accommodating therein unit packages by stacking a plurality of unit packages containing a plurality of stick-like articles aligned in parallel, an opening for putting in and out the unit packages provided on an upper part of the case, a lid for closing the opening, and an extracting outlet for extracting the unit packages or a tear-off portion for forming the extracting outlet that is provided on a side wall corresponding to the unit package in the lowest position.

Here, it is preferable that the case is a square-tubular case and that the extracting outlet or the tear-off portion for forming the extracting outlet is provided on a side wall of the case facing to one end of stick-like articles in the unit package.

The present invention further provides a battery dispensing package comprising a square-tubular case for accommodating therein unit packages by stacking a plurality of unit packages containing a plurality of batteries aligned in parallel, an opening for putting in and taking out the unit packages, a lid for closing the opening, and a tear-off portion for forming an extracting outlet for extracting the unit package that is provided on a side wall facing to one end of the batteries in the unit package in the lowest position in the case.

It is preferable that the unit packages are accommodated in such a way that they are inclined so that the front side of the case is lower and the rear side is higher.

While the novel features of the invention are set forth particularly in the appended claims, the invention, both as to organization and content, will be better understood and appreciated, along with other objects and features thereof, from the following detailed description taken in conjunction with the drawings.

DETAILED DESCRIPTION OF THE INVENTION

Figure 1:
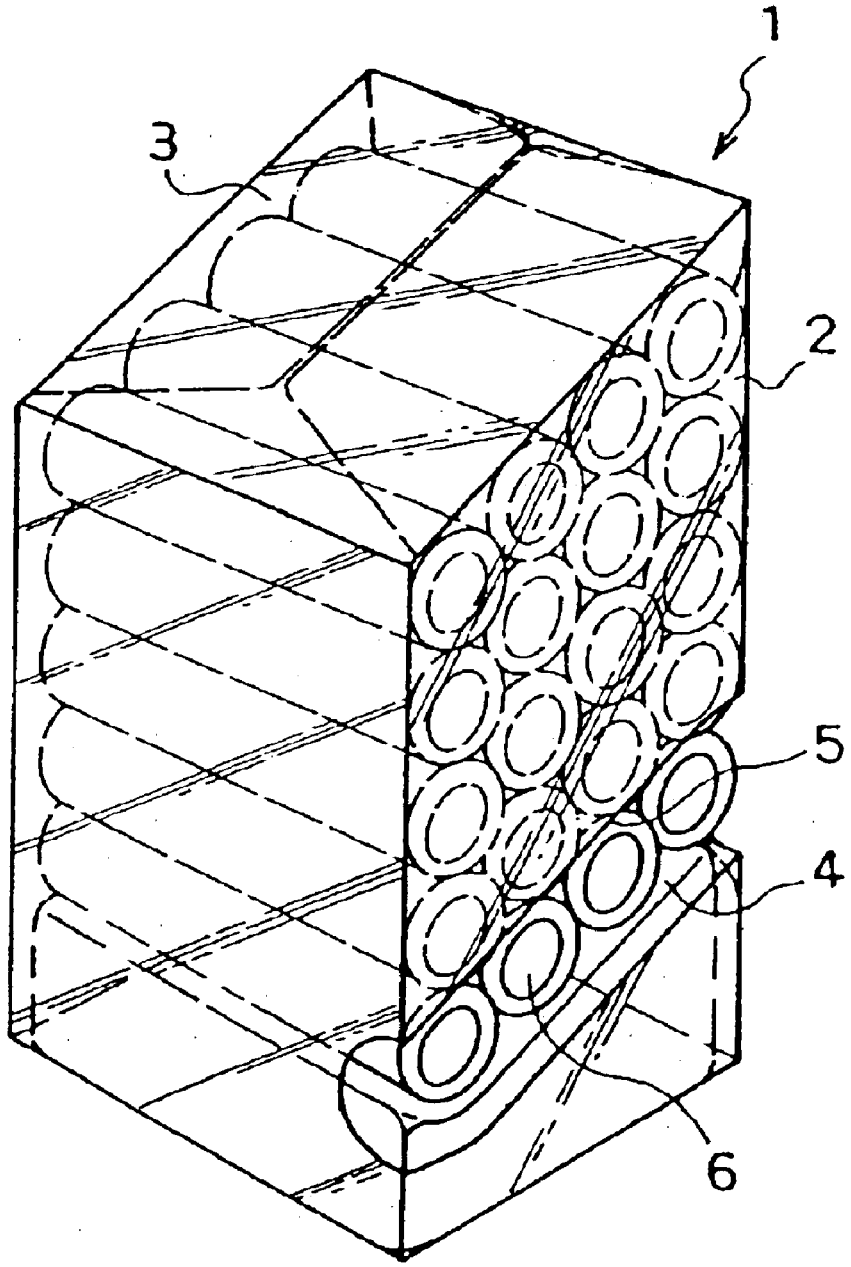
FIG. 1 is a perspective view of a dispensing package according to one embodiment of the present invention.

As explained above, the dispensing package according to the present invention accommodates unit packages containing a plurality of articles aligned in parallel by stacking a plurality of the unit packages, and a tear-off portion for forming an extracting outlet for extracting the unit package is provided on a side wall corresponding to the unit package in the lowest position. A customer who has purchased such a dispensing package can form an extracting outlet for the unit package by tearing off the tear-off portion. Thus, the unit package can be extracted from the extracting outlet when articles are required for use. The remaining unit packages can be stored in the dispensing package. In this manner, the dispensing package according to the present invention is not only capable of accommodating relatively a large number of articles but also of separating old and new articles as well as of storing remaining articles.

In a preferred mode for carrying out the present invention, articles to be accommodated are cylindrical like batteries, and the extracting outlet is formed on a side wall of the case facing one end of articles in the unit package in the lowest position. When extracting the unit package, the unit package in the lowest position, which is to be taken out, is applied with weight of unit packages that are stacked thereon. However, in the above-described arrangement, when extracting the unit package, articles in the package are pulled out by being slid in an axial direction to articles in overlying packages. Thus, in spite of the load of the unit packages that are stacked thereon is applied, the lowest unit package can be taken out smoothly.

In another preferred mode for carrying out the present invention, unit packages are accumulated so that the side facing the front wall of the case is lower and the side facing the rear wall is higher. According to this arrangement, the depth of the dispensing package can be reduced so that display densities can be improved at limited spaces. Further, in addition to the provision of the extracting outlet on the side wall of the case, a part of the load of the overlying packages exerts on the front wall of the case when the unit package is extracted, so the unit package can be extracted even easier. Similarly, by arranging the lid of the case to be inclined, indications related to types, grades or brands of contents displayed on the lid are visible from the front, therefore displaying effects can also be improved.

The dispensing package of the present invention is preferably provided with a bottom wall with which the case can stand independently on a mounting board or with a suspending piece for suspending the case on a top end of the case. By arranging the package to be of desktop-type and/or suspending-type, articles can be stored in a visible manner to be ready for use.

In another preferred mode for carrying out the present invention, at least the front wall of the case is transparent. With this arrangement, the unit packages in the case can be confirmed from outside. Especially when the unit packages are shrink-packages utilizing transparent resin, the articles themselves can be visually confirmed from outside. With this arrangement, types, grades or brands of articles that are marked on the articles can be easily confirmed in a visual manner so that displaying effects can be improved. Further, by applying designs on the lid or by making an arrangement with which contents can be visually confirmed, displaying effects can be further improved.

In still another mode for carrying out the present invention, a partition 9 is placed on the unit package in the highest position in the case. By putting, for instance, used batteries 7' on the partition 9, it is also convenient to collect waste materials.

In a preferred mode for carrying out the present invention, a dispensing package is assembled by a single sheet. The single sheet comprises a front wall, a rear wall and right and left side walls forming a square-tubular case for accommodating unit packages by stacking a plurality of unit packages. The dispensing package also includes flaps and a lid for closing an upper opening of the case and a bottom wall constituting a bottom of the case. A tear-off portion for forming an extracting outlet for extracting a unit package in the lowest position in the case is provided either on the left side wall or on the right side wall.

If necessary, a suspending portion may be formed at a top end of the case, for instance, on the rear wall. A base for placing the unit packages thereon can be inserted inside the case.

In still another preferred mode for carrying out the present invention, a dispensing package is assembled by a single sheet. The single sheet comprises a front wall, a rear wall and right and left side walls forming a square-tubular case for accommodating unit packages by stacking a plurality of unit packages. The dispensing package also includes flaps and a lid for closing an upper opening of the case and a first base-forming portion including bottom wall pieces, upstanding pieces and top surface pieces that are respectively connected to the lower part of the right and left side walls. A bottom wall is connected to the lower part of the front wall and a second base-forming portion including an upstanding piece, a top surface piece and a down-standing piece are respectively connected to the rear wall. A tear-off portion for forming an extracting outlet for extracting the unit package in the lowest position in the case is provided either on the left side wall or on the right side wall.

According to this arrangement, a base onto which the unit packages are placed can be incorporated into the case. Since this base is provided with legs constituted by the upstanding piece and the down-standing piece, the base is strong enough to stand the load of stacked unit packages. If necessary, a suspending portion may be formed at a top end of the case, for instance, on the rear wall.

Next, concrete embodiments will be explained.

Embodiment 1

Figure 2:
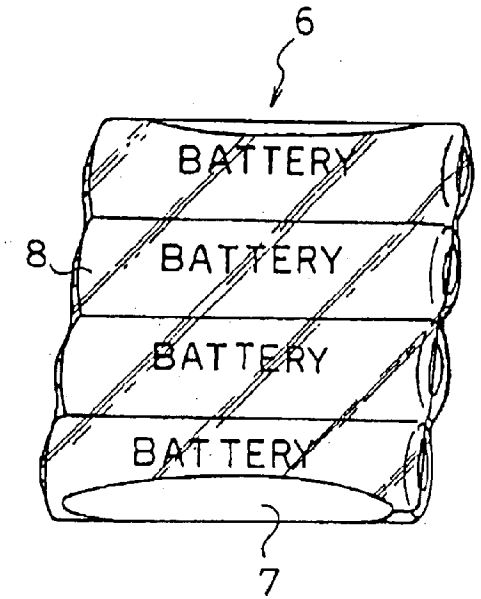
FIG. 2 is a perspective view of a battery package employed in the same embodiment.

FIG. 1 shows an example of a dispensing package, and FIG. 2 shows, as a unit package for articles, a unit package 6 of a shrink-package made of a transparent resin tube 8 in which four cylindrical AA size batteries 7, for instance, are aligned in parallel with each other and packed by heat-shrinkage of the resin tube.

The dispensing package 1 comprises a square-tubular case 2 for stacking a plurality of unit packages 6 and a lid 3 which closes an upper opening of the case. A base 4 is inserted into a bottom portion of the case 2. The base 4 is made of plastic and formed into a square-tubular shape having an open bottom surface and a top surface being inclined so that a front side is lower and a rear side is higher. The unit packages 6 are stacked on the base 4 in the case 2 in such a way that they are inclined so that their front side is lower. An extracting outlet 5 for extracting the unit package in the lowest position is formed on the right side wall of the case 2. The extracting outlet 5 is formed by tearing off a tear-off portion that have been preliminarily marked off by means of perforations in the portion constituting the right side wall of the case. The dispensing package has a bottom wall with which it can stand independently on a table. If necessary, a piece for suspending the case having a suspending hole may be provided on a part of the case, for instance, on a rear wall.

In this example, the dispensing package 1 is made of transparent plastic sheet such as polyethylene terephthalate.

The unit packages 6 are stacked so that the ends of the batteries face to the side walls of the dispensing package and so that the trunk portion of the batteries are positioned to the front of the dispensing package therefore the types, grades or brands that are marked on the batteries can be visually confirmed from the front of the dispensing package. The extracting outlet 5 for extracting each unit package is provided on the side wall facing one end of the batteries 7 in the unit package 6, so the unit package is pulled out in an axial direction of the batteries contained therein when extracting the unit package. At this time, the trunk portion of the batteries of the unit package to be extracted are made to slide in an axial direction to the trunk portion of the batteries of an overlying unit package so that the unit package can be easily extracted in spite of the load of the overlying unit packages. If the unit package is to be extracted in a vertical direction to the axis of the batteries it cannot be extracted easily because concaves and convexes extending in a vertical direction to the extracting direction are formed on the top surface of the unit package.

While the extracting outlet is formed on the side wall of the case, it may also be formed on the front wall or the rear wall of the case. The material for the case is not limited to plastics and it is also possible to use paper or the like.

Embodiment 2

In this embodiment, the base portion according to Embodiment 1 is also assembled by a sheet constituting a dispensing package.

Figure 3:
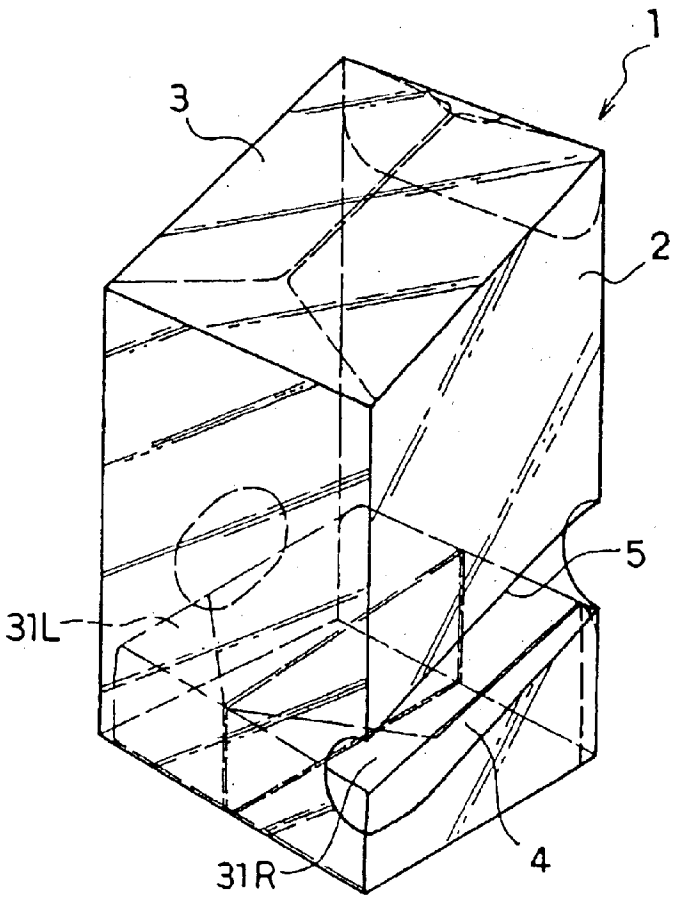
FIG. 3 is a perspective view of a dispensing package according to another embodiment of the present invention.
Figure 4:
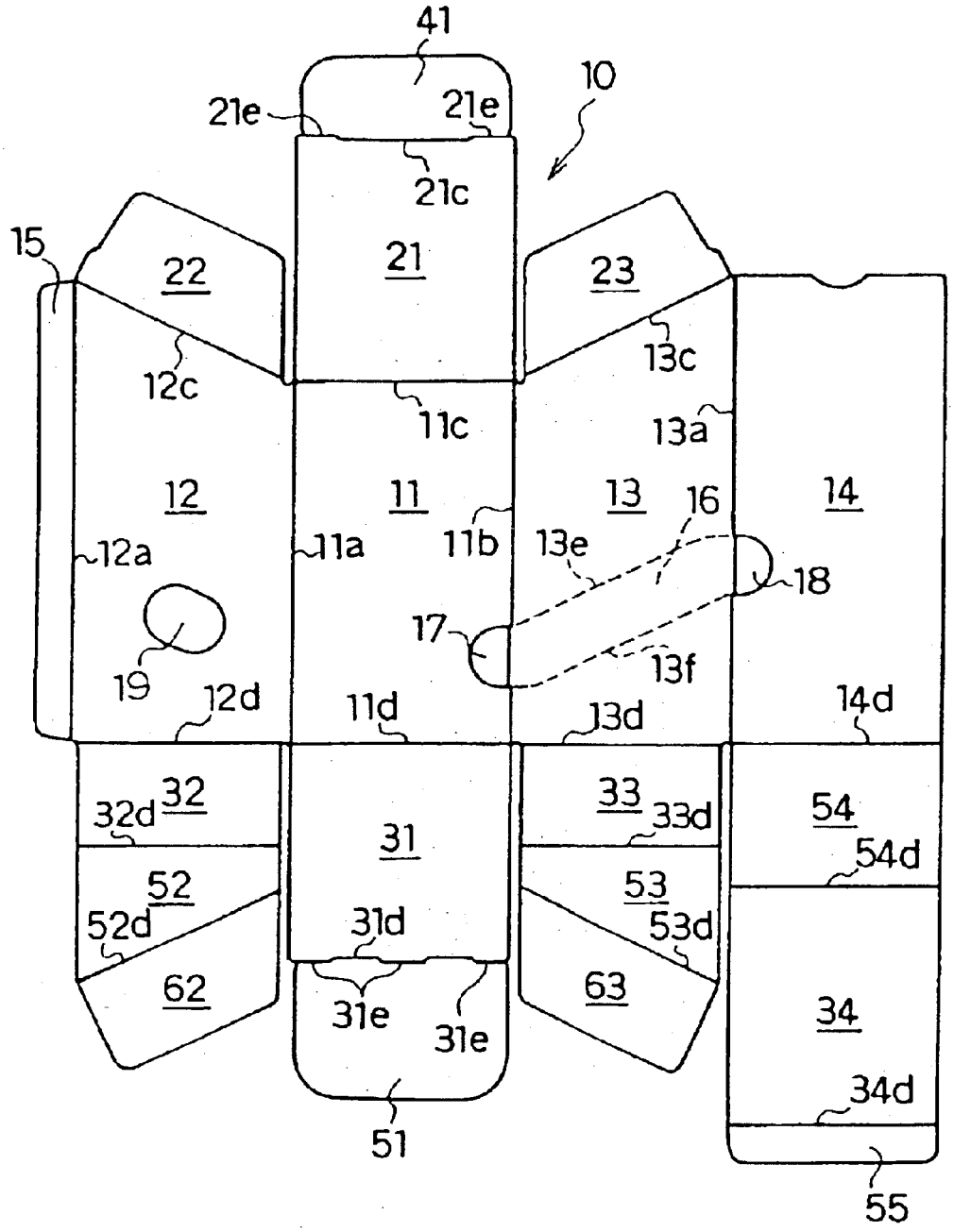
FIG. 4 is a is an exploded view of a sheet constituting a dispensing package according to the same embodiment.

FIG. 3 illustrates an assembled dispensing package and FIG. 4 is an exploded view of a sheet constituting the package.

A sheet 10 constituting the dispensing package is made of a sheet of plastic or paper punch-processed by using a specified mold, and folding marks and perforations that are to be described later are formed on the sheet at the same time.

Numeral 11 denotes a front wall and a left side wall 12 is connected via a folding mark 11*a* to the left of the front wall 11 and a right side wall 13 via a folding mark 11*b* on the right of the front wall 11, respectively. A rear wall 14 is connected to further right to the right side wall 13 via a folding mark 13*a*, and a margin for paste 15 to the left side wall 12 via a folding mark 12*a*.

An upper wall 21 and a bottom wall 31 are connected to above and below, respectively, of the front wall 11, via folding marks 11*c* and 11*d*, respectively. Further, an inserting piece 41 is connected to the upper wall 21 via a folding mark 21*c* and an inserting piece 51 is connected to the bottom wall 31 via a folding mark 31*d*. Cuts 21*e* are provided at both ends of the folding mark 21*c* and cuts 31*e* are provided at both ends and the center of the folding mark 31*d*.

A flap 22 is provided on an upper portion of the left side wall 12 via a folding mark 12*c*, and on a lower portion of the left side wall 12, there are sequentially provided a folding mark 12*d*, bottom wall piece 32, folding mark 32*d*, upstanding piece 52, folding mark 52*d* and a top surface piece 62.

On an upper portion of the right side wall 13, a flap 23 is provided via a folding mark 13*c*, and on a lower portion of the right side wall 13, there are sequentially provided a folding mark 13*d*, bottom wall piece 33, folding mark 33*d*, upstanding piece 53, folding mark 53*d* and a top surface piece 63.

On a lower portion of the rear wall 14, there are sequentially formed a folding mark 14*d*, upstanding piece 54, folding mark 54*d*, a top surface piece 34, a folding mark 34*d*, and an down-standing piece 55.

A tear-off portion 16 is marked off by means of perforations 13*e* and 13*f* on the right side wall 13 and apertures 17 and 18 are respectively provided on the front wall 11 and the rear wall 14 adjacent to the right and the left of the tear-off portion. An aperture 19 is formed on the left sidewall 12.

A method for assembling the dispensing package by using the sheet 10 will be explained now.

Figure 5:
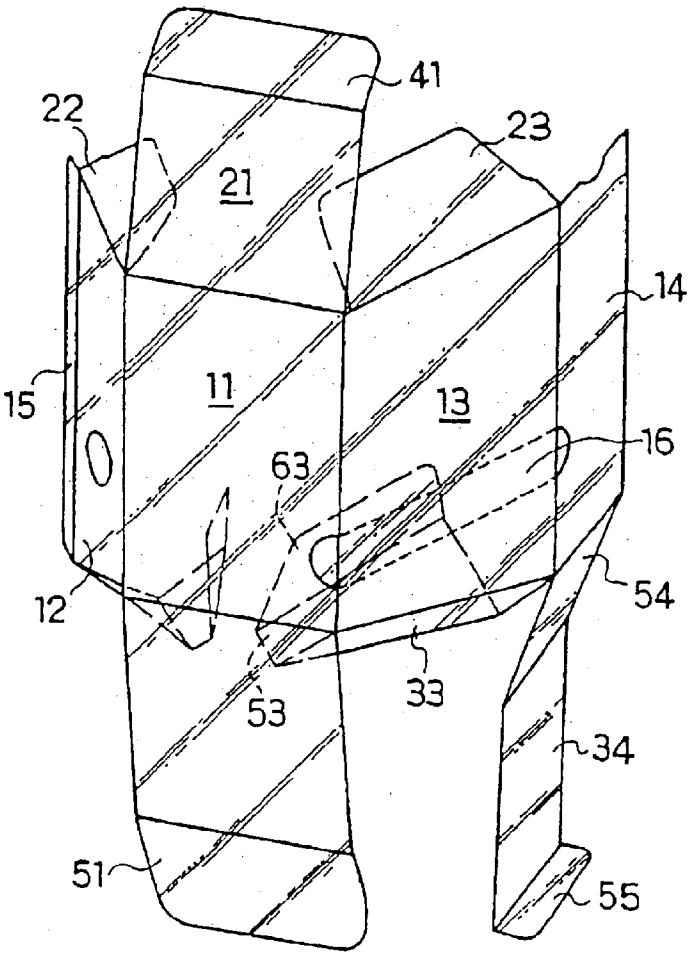
FIG. 5 is a perspective view showing assembling processes of the same dispensing package.
Figure 6:
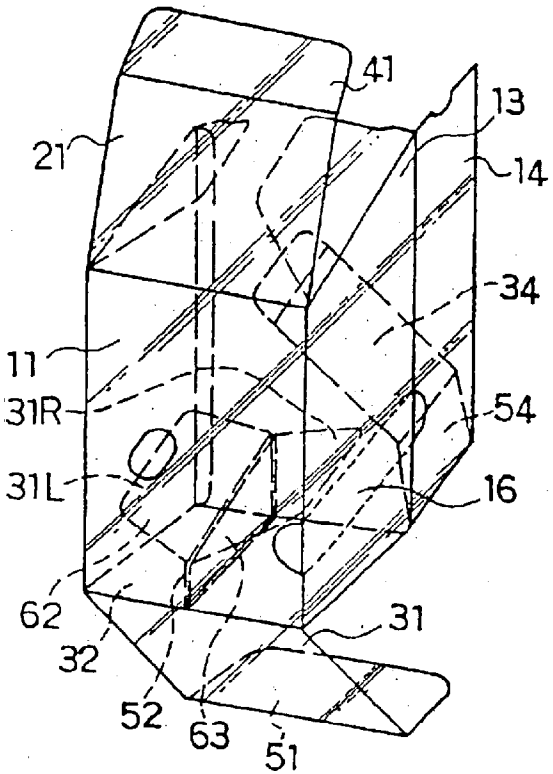
FIG. 6 is a perspective view showing a condition in which assembly has further progressed.

FIG. 5 and FIG. 6 are perspective views of assembling processes when seen from the side of the front wall 11.

First, the left side wall 12, the margin for paste 15, the right side wall 13 and the rear wall 14 are bent at right angles to respective adjoining pieces so that the folding marks 11*a*, 11*b*, 12*a* and 13*a* face outward. The margin for paste 15 is adhered to inner surface of the rear side wall 14 at a proper step of assembly.

Next, the bottom wall piece 32, upstanding piece 52 and the top surface piece 62 are bent at right angles to their adjoining pieces so that the folding marks 12*d*, 32*d* and 52*d* face outward. Similarly, the bottom wall piece 33, upstanding piece 53 and the top surface piece 63 are bent at right angles to their adjoining pieces at the folding marks 13*d*, 33*d* and 53*d*.

Then, the bottom wall 31 and the inserting piece 51 are bent at right angles at folding marks 11*d* and 31*d*.

Furthermore, the upstanding piece 54 is bent at folding mark 14*d* and is overlapped to an inner surface of the rear wall 14 and the top surface piece 34 and the down-standing piece 55 are bent to make right angles to adjoining pieces so that the folding marks 54*d* and 34*d* face inward.

Then, by placing the bottom wall piece 32 on a top surface of the bottom wall 31, the top surface piece 62 forms a base portion 31L, having a lower front side between the rear wall 14 and the upstanding piece 54 that has been overlapped onto the inner surface of the front wall 11 and on the left half of the bottom wall 31 by using the upstanding piece 52 as a leg. Similarly, the top surface piece 63 forms a base portion 31R having a lower front side between the rear wall 14 and the upstanding piece 54 and on the right half of the bottom wall 31 by using the upstanding piece 53 as a leg.

Upper surfaces of the base portions 31L and 31R are covered by the top surface piece 34 and the down-standing piece 55 connected to the top surface piece 34 is inserted between the front wall 11 and the base portions 31L and 31R to come in contact with the bottom wall 31. The inserting piece 51 connected to the bottom wall 31 is inserted between the rear wall 14 and the base portions 31L and 31R.

In this manner, a base is formed using the bottom wall piece 32, upstanding piece 52, and the top surface piece 62 that are connected to the left side wall 12 and bottom wall piece 33, upstanding piece 53, and the top surface piece 63 that are connected to the right side wall 13, the upstanding piece 54, top surface piece 34, and the down-standing piece 55 that are connected to the rear wall 14 cover the base, and the upstanding piece 54 and down-standing piece 55 serve as legs, so that it is possible to form a base that is strong enough to stack unit packages thereon even if it is made of a thin sheet.

Through these steps, it is possible to assemble a dispensing package having an upper opening. This opening is closed by bending the flaps 22 and 23 at the folding marks 12*c* and 13*c* at right angles to the left side wall 12 and the right side wall 13, respectively, bending the upper wall 21 at the folding mark 11*c* and also bending the inserting piece 41 at the folding mark 21*c* to make it inserted between the rear wall 14 and the flaps 22 and 23.

In this manner, the dispensing package including a support base for stacking the unit packages thereon composed of the base portions 31L and 31R and the top surface piece 34 covering the base portions is completed. It is possible to insert and stack five unit packages 6 through its upper opening, close the lid and affix a seal for display at a storefront.

Figure 7:
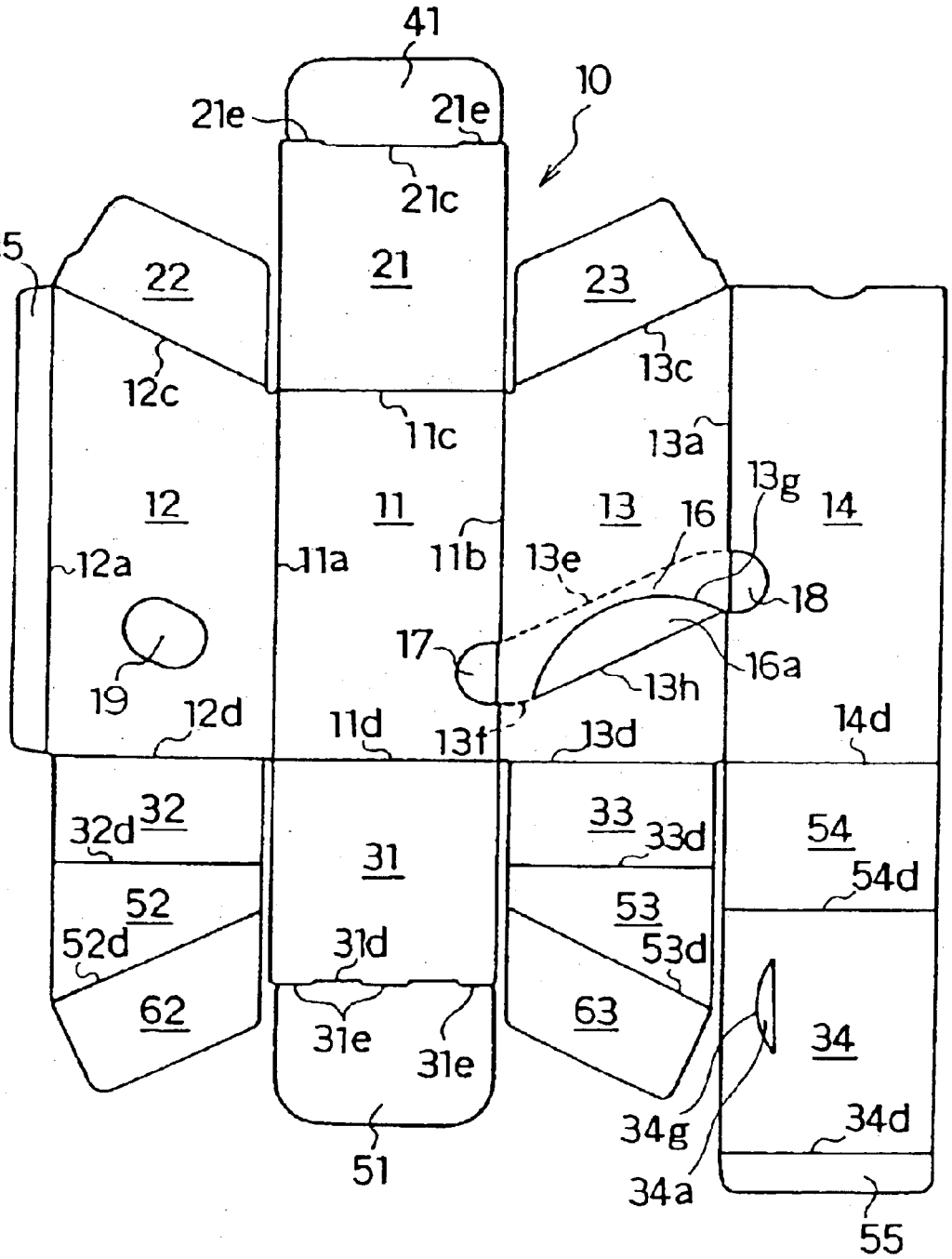
FIG. 7 is an exploded view of a modified example of the same dispensing package.

FIG. 7 shows a modified example of the above-described sheet. In this example, a tongue-shaped piece 16*a* is formed by providing a folding mark 13*h* and a cut mark 13*g* on a part of the tear-off portion 16, while a tongue-shaped piece 34*a* that has been cut and raised at a cut mark 34*g* is formed on the top surface piece 34 that forms the base portion. Then, when assembling the dispensing package, the tongue-shaped piece 16*a* is bent inward, the top surface piece 34 is overlapped thereon, and a tip end of the tongue-shaped piece 16*a* is inserted to be pinched between the top surface piece 34 and the tongue-shaped piece 34*a* by slightly pressing down the tongue piece 34*a*. In this manner, the base portion can be strengthened.

Embodiment 3

Figure 8:
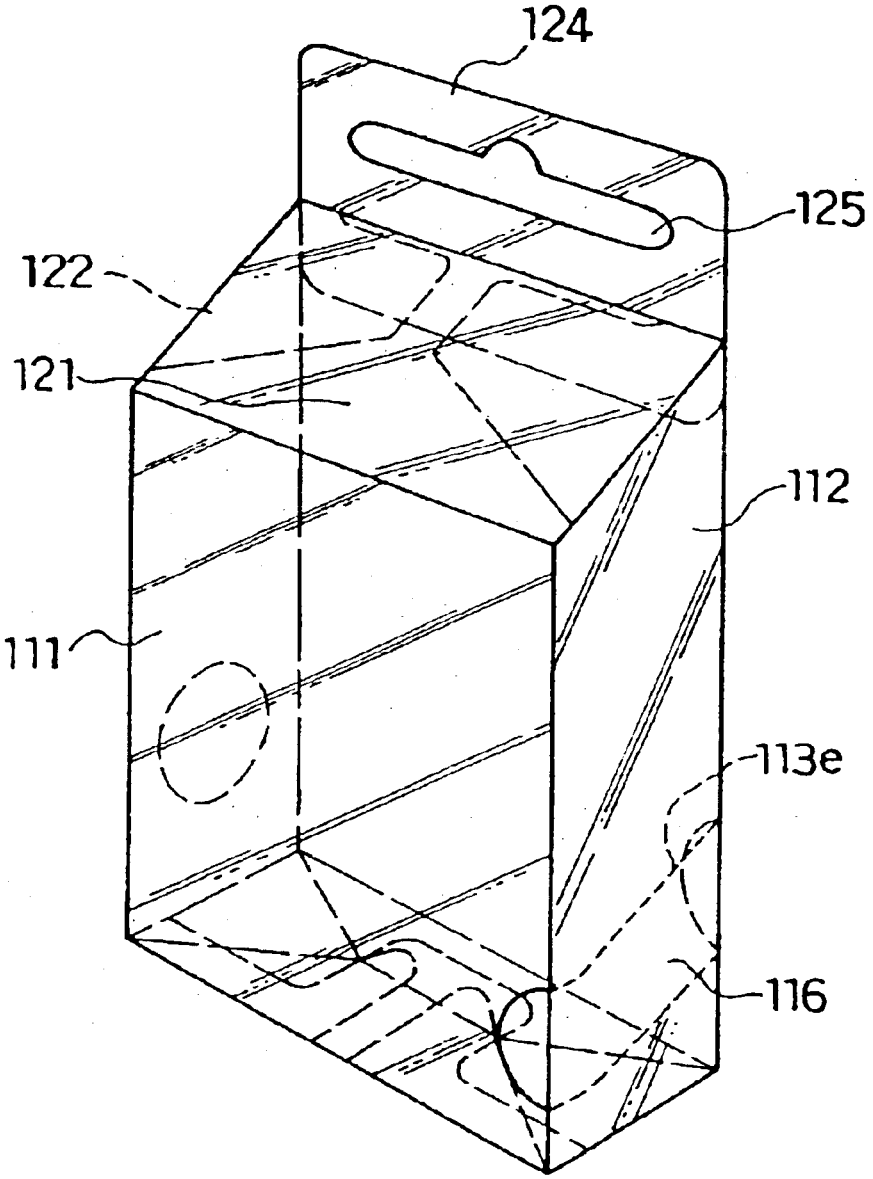
FIG. 8 is a perspective, view of a dispensing package according to still another embodiment of the present invention.
Figure 9:
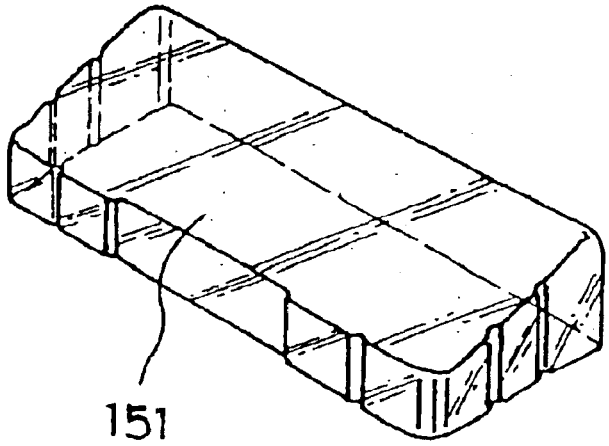
FIG. 9 is a perspective view of a base that is to be combined with the same package.
Figure 10:
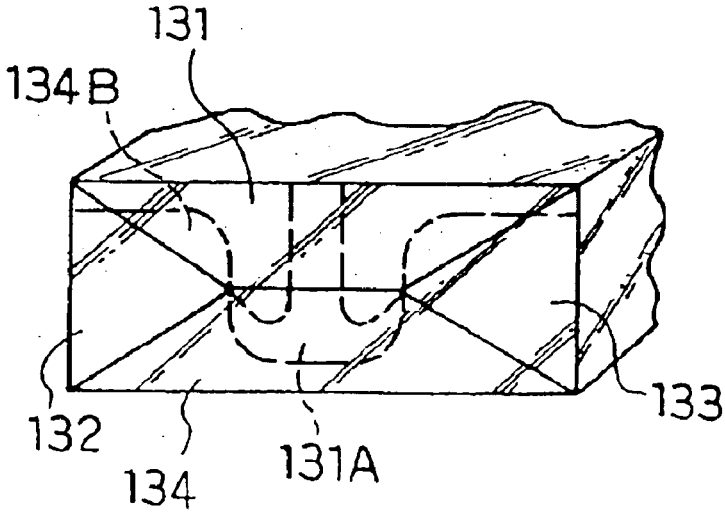
FIG. 10 is a perspective view showing a bottom of the same package.

The present embodiment illustrates an example in which the base portion for stacking the unit packages thereon is formed separately from the sheet for assembling the package. FIG. 8 is a perspective view of an assembled package, FIG. 9 is a perspective view showing a base to be inserted into the bottom portion of the package, and FIG. 10 is a perspective view showing a bottom wall of the package.

Figure 11:
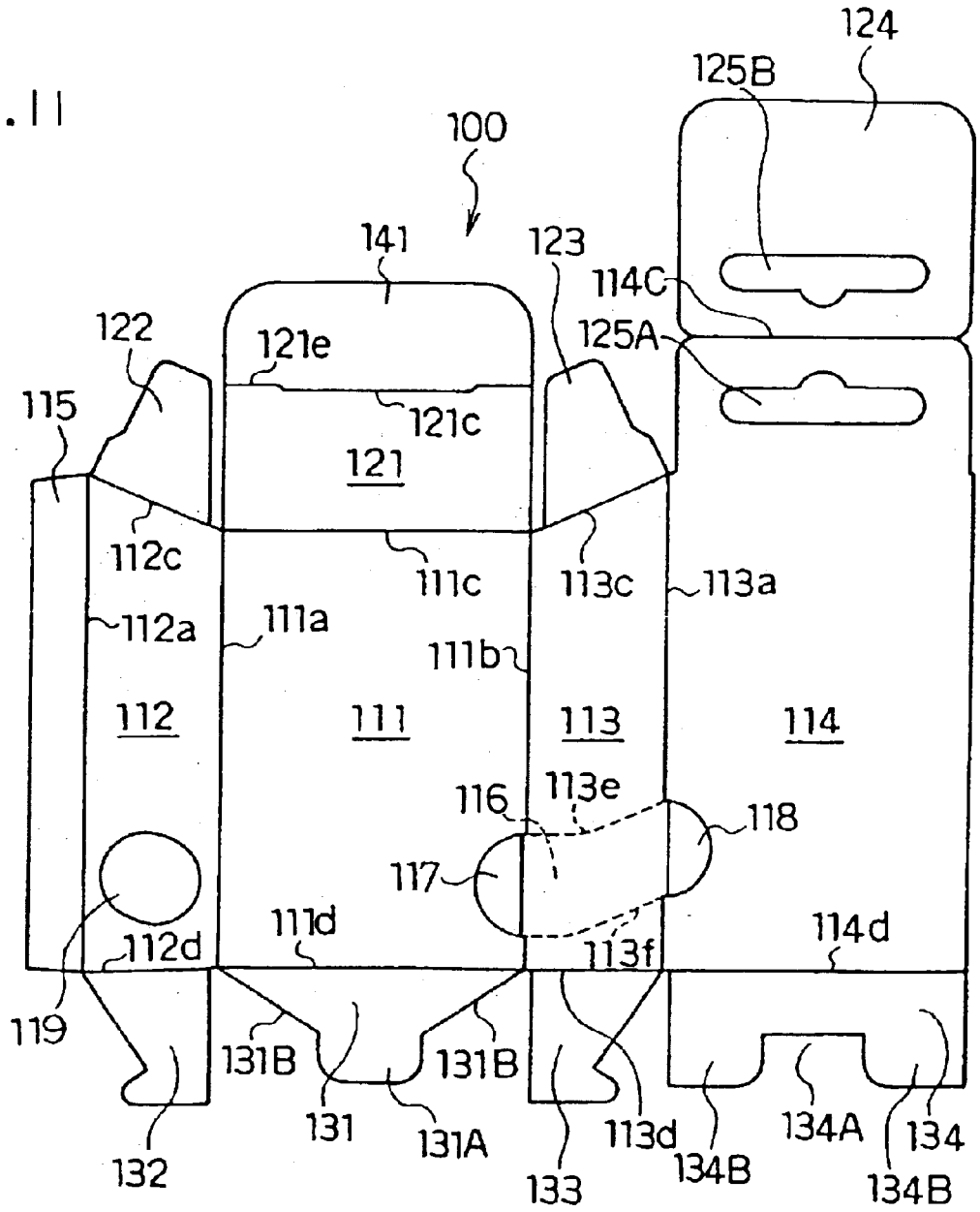
FIG. 11 is an exploded, view showing a sheet comprising the same package.
Figure 12:
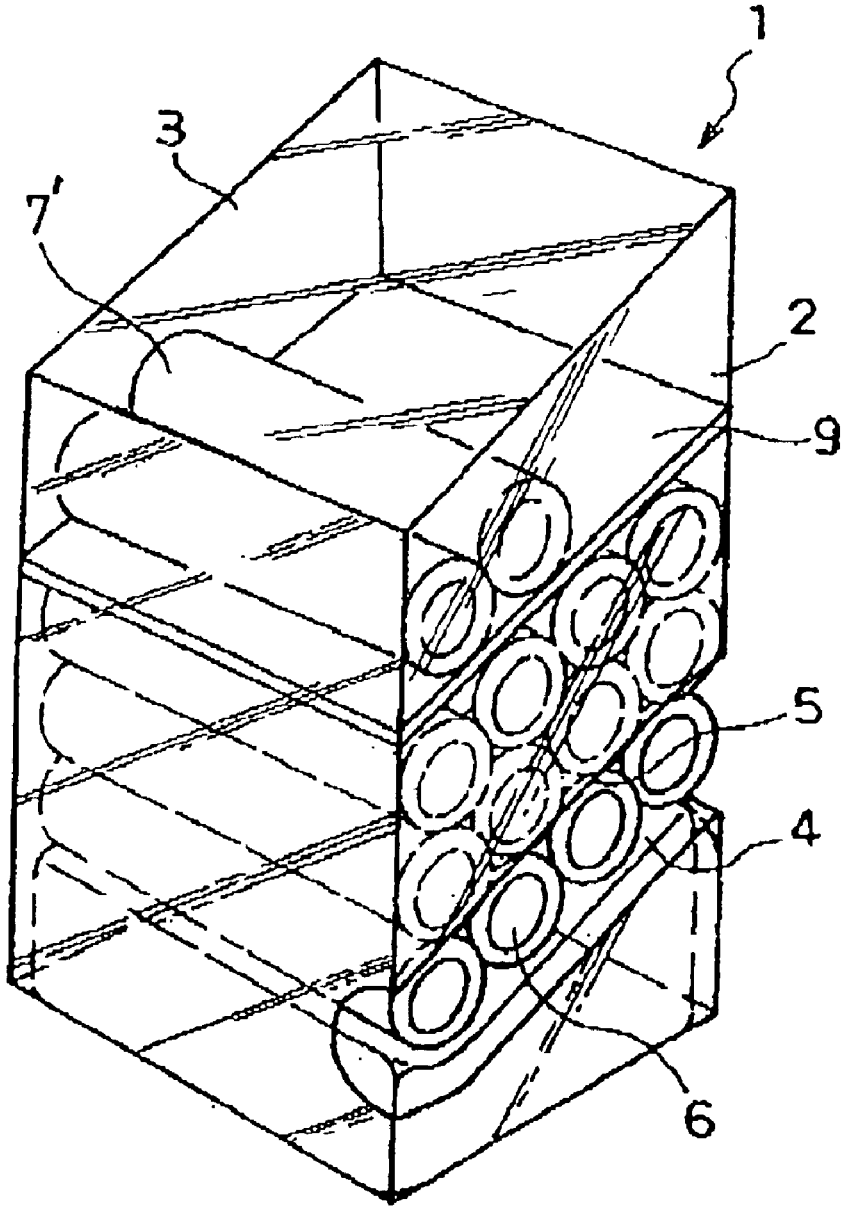
FIG. 12 is a perspective view of a dispensing package according to yet another embodiment of the present invention.

First, a sheet constituting the package will be explained with reference to the exploded view as shown in FIG. 11.

Numeral 111 denotes a front wall. A left side wall 112 is provided on the left side of the front wall 111 via a folding mark 111*a*, and to the left of the left side wall 112, a margin for paste 115 is provided via a folding mark 112*a*. A right side wall 113 is provided on the right side of the front wall 111 via a folding mark 111*b*, and to the right of the right side wall 113, a rear wall 114 is provided via a folding mark 113*a*.

On an upper portion of the front wall 111, there is provided a top wall 121 via a folding mark 111*c* and on an upper portion of the top wall 121, an inserting piece 141 is provided via a folding mark 121*c*. On a lower portion of the front wall 111, there is provided a bottom wall piece 131 via a folding mark 111*d*. At both ends of the folding mark 121*c*, there are provided cuts 121*e*.

A flap 122 is provided on an upper portion of the left side wall 112 via a folding mark 112*c*, and on a lower portion of the left side wall 112, a bottom wall piece 132 is provided via a folding mark 112*d*.

Similarly, a flap 123 is provided on an upper portion of the right side wall 113 via a folding mark 113*c* and on a lower portion of the right side wall 113, a bottom wall piece 133 is provided via a folding mark 113*d*.

A lapel piece 124 is provided at an upper portion of the rear wall 114 via a folding mark 114*c* and the lapel piece 124 and a corresponding portion of the rear wall 114 are provided with suspending holes 125B and 125A by punching. At a lower portion of the rear wall 114, a bottom wall piece 134 is provided via a folding mark 114*d*.

A tear-off portion 116 is marked off by means of perforations 113*e* and 113*f* on the right side wall 113 and apertures 117 and 118 are respectively provided on the front wall 111 and the rear wall 114 adjacent to the right and the left of the tear-off portion. An aperture 119 is formed on the left side wall 112.

In order to assemble the dispensing package by using the sheet 100, the sheet is bent at right angles at the folding marks 111*a*, 111*b*, 112*a* and 113*a* so that the folding marks face outward, and the margin for paste 115 is adhered to the rear wall 114.

Thereafter, the bottom wall pieces 131, 132, 133 and 134 are bent inward at right angles at the folding marks 111*d*, 112*d*, 113*d* and 114*d*. At this time, the bottom wall piece 134 is placed onto the bottom wall pieces 132 and 133, and a tip end of an extruding piece 131A of the bottom wall piece 131 is inserted inward of the bottom wall piece 134 from a bottom portion of a notched portion 134A of the bottom wall piece 134. With this arrangement, the tip end of the extruding piece 131A is pinched between the bottom wall piece 134 and the bottom wall pieces 132 and 133, so that a tapered portion 131B connected to the extruding piece 131A presses against inward end portions of both tip end portions 134B of the bottom wall piece 134. In this way, a dispensing package having a closed bottom and an upper opening is produced.

Then, the base 151 is inserted into the dispensing package. The base 151 is formed so that the top surface and the four side walls are molded, with the top surface inclined in such a way that the front side is lower and the rear side is higher.

Next, the flaps 122 and 123 are bent inward at the folding marks 112*c* and 113*c*, then the upper wall 121 is bent inward at the folding mark 111*c* and the inserting piece 141 is bent at the folding mark 121*c*, and subsequently insert the inserting piece 141 is inserted between the rear wall 114 and the flaps 122 and 123, thereby to close the opening of the dispensing package.

The dispensing package as illustrated herein is for stacking unit packages of, for instance, two AAA size batteries aligned with each other.

INDUSTRIAL APPLICABILITY

As explained above, the present invention provides a dispensing package that can, not only store a relatively large number of articles but can also separate used and new articles and store articles in stock, and further can exhibit great displaying effects.

What is claimed is:

1. A dispensing package comprising:

a square-tubular case housing stacked unit packages, each package containing a plurality of stick-like articles aligned in parallel with the front wall of the square-tubular case, a first stick-like article of each unit package being positioned adjacent the front wall and a second stick-like article being positioned adjacent a rear wall of the square-tubular case;

an opening for putting in and out the unit packages provided on an upper part of said square-tubular case;

a lid for closing said opening;

a bottom; and an extracting outlet or a tear-off portion for forming an extracting outlet for extracting the unit packages one at a time, the extracting outlet or tear-off portion being inclined so that a front end is lower than a rear end, wherein a top surface of said bottom is inclined so that a front side of the bottom is lower than a rear side thereof and said extracting outlet or the tear-off portion is provided on a side wall of said square-tubular case such that the unit package, which is to be placed on the top surface of the bottom, is taken out of the outlet from one end of the stick-like articles in the unit package.

2. The dispensing package in accordance with claim 1, wherein said unit packages contain a plurality of batteries aligned in parallel with the front wall of the square-tubular case.

3. The dispensing package in accordance with claim 1, wherein said square-tubular case has a bottom surface with which the square-tubular case can stand independently on a mounting board.

4. The dispensing package in accordance with claim 1, wherein a suspending piece for suspending the square-tubular case is provided on a top end of the square-tubular case.

5. The dispensing package in accordance with claim 1, wherein at least the front wall of the square-tubular case is transparent.

6. The dispensing package in accordance with claim 1, wherein a partition is placed on the unit package in the highest position in the square-tubular case.

7. The dispensing package in accordance with claim 1, wherein said dispensing package is assembled by a single sheet and a base, the base including a top surface which is inclined so that a front side of the base is lower than a rear side thereof, said single sheet comprising:

a front wall, a rear wall and right and left side walls forming the square-tubular case;

flaps and a top wall for closing the upper opening of the square-tubular case;

a bottom wall constituting a bottom of the square-tubular case; and a tear-off portion for forming the extracting outlet.

8. A dispensing package comprising:

a square-tubular case housing stacked unit packages, each package containing a plurality of stick-like articles aligned in parallel with the front wall of the square-tubular case;

an opening for putting in and out the unit packages provided on an upper part of said square-tubular case;

a lid for closing said opening;

a bottom; and an extracting outlet or a tear-off portion for forming an extracting outlet for extracting the unit package, the extracting outlet or tear-off portion being inclined so that a front end is lower than a rear end, wherein a top surface of said bottom is inclined so that a front side of the bottom is lower than a rear side thereof and said extracting outlet or the tear-off portion is provided on a side wall of said square-tubular case such that the unit package, which is to be placed on the top surface of the bottom, is taken out of the outlet from one end of the stick-like articles in the unit package, wherein said dispensing package is assembled by a single sheet, said single sheet comprising:

a front wall, a rear wall and right and left side walls forming the square-tubular case;

flaps and a top wall for closing the upper opening of the square-tubular case;

a first base-forming portion including bottom wall pieces, upstanding pieces and top surface pieces that are respectively connected to the lower part of said right and left side walls;

a bottom wall connected to a lower part of said front wall;

a second base-forming portion including an upstanding piece, a top surface piece and a down-standing piece that are respectively connected to the rear wall; and a tear-off portion for forming the extracting outlet.

9. A dispensing package comprising:

a square-tubular case housing stacked unit packages, each unit package containing a plurality of cylindrical batteries aligned in parallel with the front wall of the square-tubular case, a first battery of each unit package being positioned proximate the front wall and a second battery of each unit package being positioned proximate a rear wall of the square-tubular case, the batteries being assembled in parallel in said unit packages and each battery having a diameter;

an opening for putting in and out the unit packages provided on an upper part of said square-tubular case;

a lid for closing said opening;

a bottom; and an extracting outlet or a tear-off portion for extracting one of the unit packages, the extracting outlet or tear-off portion being inclined so that a front end is lower than a rear end, the extracting outlet extending from a first end adjacent the front wall of the square-tubular case to a second end adjacent a rear wall of the square-tubular case, wherein a top surface of said bottom is inclined so that a front side of the bottom is lower than a rear side thereof and said extracting outlet or the tear-off portion is provided on a side wall of said square-tubular case, a height of the extracting outlet or tear-off portion from the first end to the second end thereof being less than twice a diameter of the batteries such that the unit package that is in facing engagement with the top surface of the bottom is taken out of the outlet from one end of the batteries in the unit package.

10. A dispensing package comprising:

a tubular case including a bottom and side walls, said bottom including a top surface, a front side and a rear side, said top surface being inclined so that said front side is lower than said rear side;

an opening in an upper part of said tubular case;

a lid for closing said opening; and an extracting outlet or a tear-off portion being formed in one of said side walls, said extracting outlet or tear-off portion including a front end, a rear end, and a mid-portion between the front and rear ends, said extracting outlet or tear-off portion being inclined so that said front end is lower than said rear end, the tubular case housing a plurality of stacked unit packages, each of the unit packages comprised of a plurality of batteries positioned in a side-by-side relationship, a first battery in each unit package being positioned adjacent a front wall of said tubular case and a second battery in each unit package being positioned adjacent a rear wall of said tubular case, a base unit package being in facing engagement with the top surface of the bottom wall, the first battery of the base unit package being positioned proximate the front end of the extracting outlet and the second battery of the base unit package being positioned proximate the rear end of the extracting outlet.

11. A dispensing package comprising:

a tubular case including two opposing side walls and opposing front and rear walls, the case housing stacked unit packages, each package containing a plurality of stick-like articles aligned in parallel with the front wall of the tubular case, the stick-like articles being stacked in a side-by-side relationship in each unit package and having a first stick-like article and a second stick like article positioned at either end of the unit packages;

an opening for putting in and out the unit packages provided on an upper part of said tubular case;

a lid for closing said opening;

a bottom; and an extracting outlet or a tear-off portion for forming an extracting outlet for extracting one of the unit packages, the extracting outlet or tear-off portion being inclined so that a front end is lower than a rear end, wherein a top surface of said bottom is inclined so that a front side of the bottom is lower than a rear side thereof and said extracting outlet or the tear-off portion is provided on a side wall and extends to portions of the front and rear walls of said tubular case such that the unit package, which is to be placed on the top surface of the bottom, is removed by pulling one end of the stick-like articles in the unit package through the opening in the side wall by grasping the unit package through the extracting outlet adjacent the first and second stick-like articles, respectively, the first stick-like article being positioned adjacent the front wall of the tubular case and the second stick-like article being positioned adjacent the rear wall of the tubular case.

* * * * *